US006095263A

United States Patent [19]

Saunders et al.

[11] Patent Number: 6,095,263

[45] Date of Patent: Aug. 1, 2000

[54] DRILL RIG OPERATOR CAB VIEWPORT

[75] Inventors: Larry L. Saunders, Varsailles; Tony R. Barnett, Wurtland, both of Ky.

[73] Assignee: Svedala Industries, Inc., Waukesha, Wis.

[21] Appl. No.: 09/219,661

[22] Filed: Dec. 23, 1998

[51] Int. Cl.[7] ..... E21B 41/00

[52] U.S. Cl. ..... 175/219; 175/209; 52/112; 52/171.1

[58] Field of Search ..... 296/190.01, 190.08, 296/146.15, 201; 175/209, 210, 122, 219; 52/112, 171.1

[56] References Cited

U.S. PATENT DOCUMENTS

| | | | |
|---|---|---|---|
| 1,972,846 | 9/1934 | Kelley | 175/209 |
| 3,756,330 | 9/1973 | Russell, Jr. | 173/44 |
| 3,800,890 | 4/1974 | Gyongyosi et al. | 175/209 |
| 3,863,787 | 2/1975 | Ertl | 414/406 |
| 4,434,861 | 3/1984 | Howeth | 175/66 |
| 4,580,312 | 4/1986 | Van Raaij | 15/339 |
| 4,732,462 | 3/1988 | Bel | 359/872 |

*Primary Examiner*—D. Glenn Dayoan
*Assistant Examiner*—Patricia Engle
*Attorney, Agent, or Firm*—Kinney & Lange, P.A.

[57] ABSTRACT

A viewport is located in the floor of a drill rig operator's cab to enable a rig operator to view drilling operations. As drilling commences, the operator may view the material underlying the rig and make a visual determination that the coal seam has been reached, by identifying that the material has the characteristic black color of the coal. When the coal seam is reached, the drilling operation is then altered accordingly to prevent overdrilling.

8 Claims, 2 Drawing Sheets

DRILL RIG OPERATOR CAB VIEWPORT

BACKGROUND OF THE INVENTION

1. Technical Field

This invention relates generally to rotary drill rigs and, in particular, to devices for assisting an operator of a rotary drill rig to identify progress of a given drilling operation.

2. Description of the Related Art

Drilling operations in a coal mining environment are quite harsh. Known rotary drills typically include an enclosed steel and glass operator's cab to protect a rig operator from the weather, noise and other elements. During such drilling operations, however, the rig operator must be quite careful to ensure against overdrilling into the coal seam, which significantly reduces yield and increases cost. The operator is not always able to determine when the drill has reached the coal seam due to the relatively closed cab environment.

The present invention addresses this problem.

BRIEF SUMMARY OF THE INVENTION

It is an object of the present invention to provide a viewport, preferably in the floor of a drill rig operator's cab, to enable a rig operator to view drilling operations. As drilling commences, the operator thus may view the material underlying the rig and make a visual determination that the coal seam has been reached (e.g., by identifying that the material has the characteristic black color of the coal). When the coal seam is reached, the drilling operation is then altered accordingly to prevent overdrilling.

It is thus an object to provide a viewing port within an operator's cab of a drill rig so that the operator may more closely monitor and control drilling operations while such operations take place.

It is a more general object to provide an improved operator cab for a drill rig.

It is another more general object to decrease the likelihood of overdrilling a coal seam using a rotary drilling rig.

Still another more general object of this invention is to reduce the amount of product lost as a result of overdrilling a coal seam due to the inability of a rig operator to ascertain when the drill has contacted the seam.

The foregoing has outlined some of the more pertinent objects and features of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the Preferred Embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENT

Figure 1:
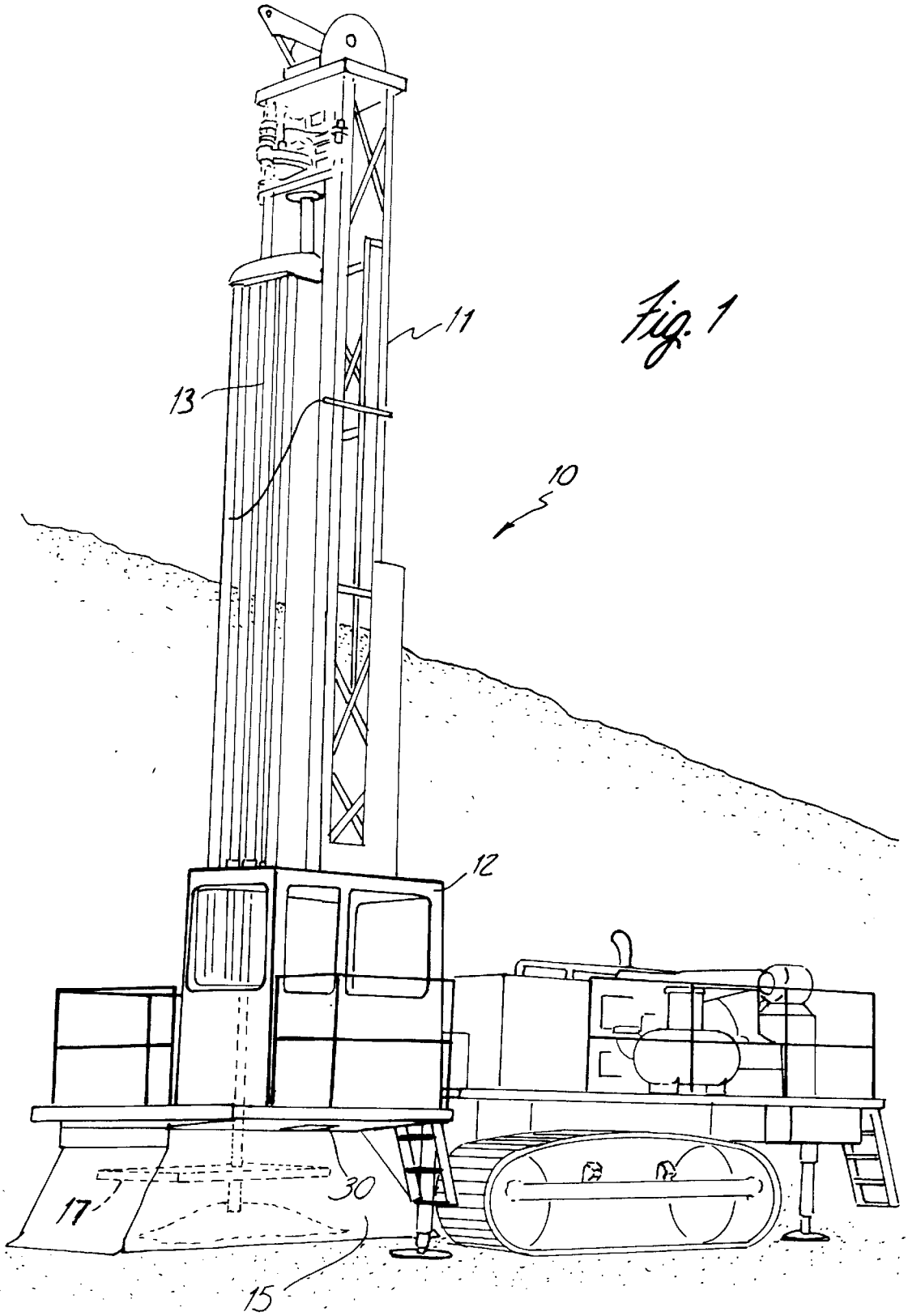
FIG. 1 is a perspective view of a representative rotary drill in which the present invention is implemented.

FIG. 1 is a perspective view of a perspective view of a representative rotary drill 10 in which the present invention is implemented. The rotary drill is crawler-mounted, although one of ordinary skill will appreciate that the invention may be implemented in a truck-mounted rotary drill as well.

As is well-known, the rotary drill 10 includes an operator cab 12 for the drill operator and a drilling mast 11 into which drill pipe 13 is mounted. Typically, the operator cab overlies a dust skirt 15, which forms part of a dust system designed to remove visible dust from the drilling air. A drilling mast base 17 and the skirt increase dust system efficiency by separating large granular chips before entry into the dust system.

Figure 2:
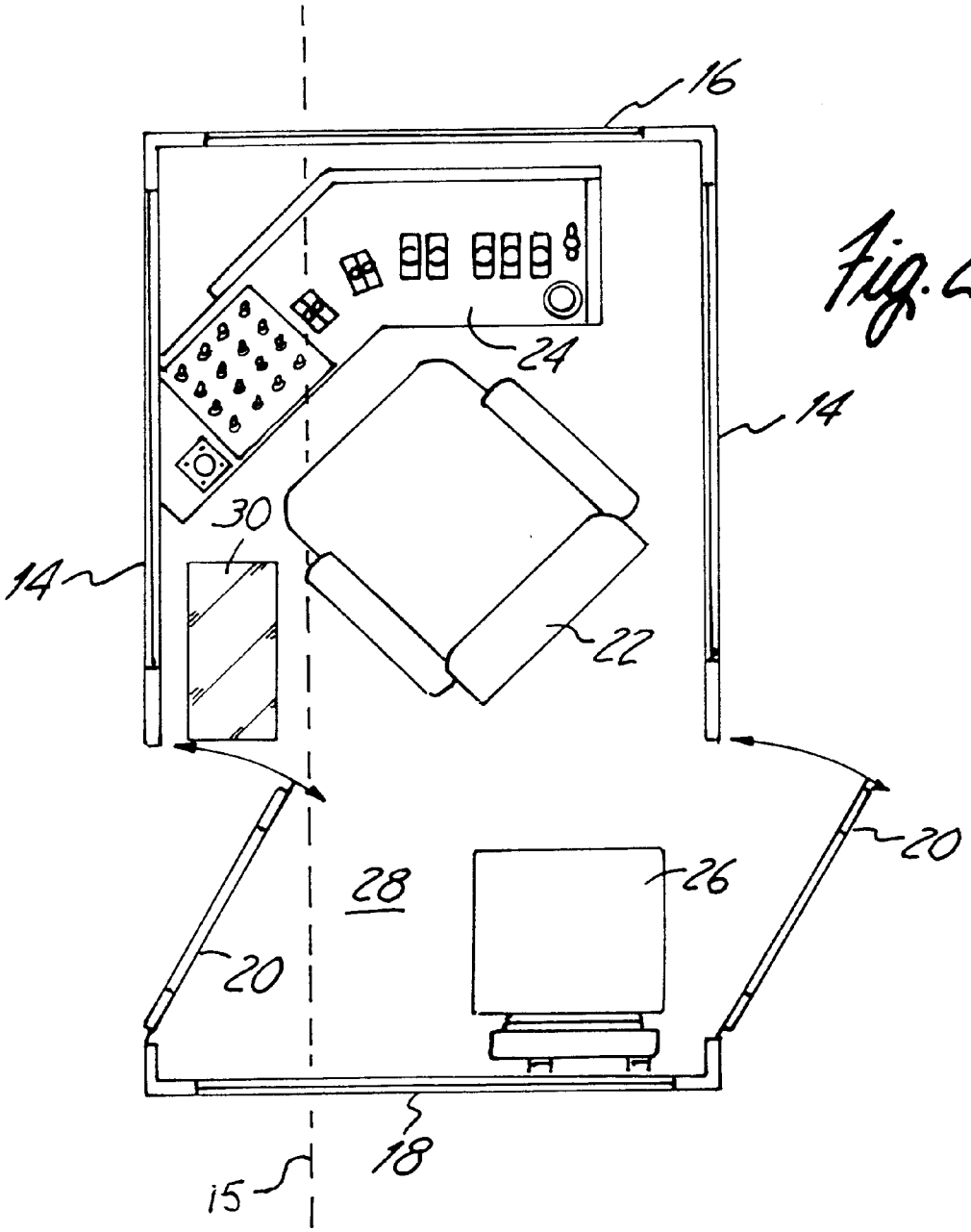
FIG. 2 is a plan view of an operator's cab having the inventive viewport of the present invention.

Referring briefly to FIG. 2, which is a plan view of the operator cab 12, the cab comprises a pair of sidewalls 14, a front wall 16 and a back wall 18. A door 20 is provided in each sidewall 14. A seat 22, which may swivel or rotate about its axis, is located before a control console 24. Control console 24 includes a set of controls and gauges for use in managing the rig operations, as is well known. An additional jumpseat 26 is also provided.

According to the invention, the operator cab floor 28 includes a cutout portion 30 that forms a viewport in the floor 28. The viewport includes a clear glass or plexiglass material so that a rig operator (or someone else located within the operator cab) may view conditions underlying the rig.

In particular, the viewport is preferably located along an outside edge of the dust skirt 15, shown in phantom (as this edge underlies the floor of the operator cab). As a result, as the drilling operation proceeds, the rig operator (or the helper) directly views the material adjacent the skirt. As the color of the material turns from brown to black (i.e. from shale to coal), the operator may then take (or be instructed to take) the necessary actions to prevent overdrilling into the coal seam. As a result, the amount of lost production is significantly reduced, thereby increasing yield.

The particular location of the viewport depends on the form factor of the operator cab and the relative position of the cab with respect to the underlying skirt edge. As illustrated in FIG. 2, the viewport is preferably located adjacent the operator's cab seat 22 so that the operator does not need to leave the seat to view the operation. The particular size and shape of the viewport window is not a limitation of the present invention.

Having thus described our invention, what we claim as new is described in the appended claims.

What is claimed is:

1. A rotary drill rig, comprising:

a drilling mast;

a drilling mast base disposed on the mast;

drill pipe held in position by the drilling mast;

a dust skirt at least partially surrounding the drilling mast base;

an operating cab floor overlying at least a portion of the dust skirt;

an operating cab enclosure overlying the operating cab floor; and a viewport in the floor disposed outside and proximate to the dust skirt so that the dust skirt prevents dust generated by a drilling operation from obscuring the viewport while permitting viewing of drilling material.

2. The drill rig of claim 1, further comprising:

a set of controls disposed inside the operating cab enclosure; and a seat disposed inside the operating cab enclosure.

3. The drill rig of claim 2 wherein the seat is disposed proximate to the viewport to permit a person sitting in the seat to view the material.

4. The drill rig of claim 1 wherein the viewport comprises a cutout on the floor sealed by a transparent material.

5. In a rotary drill having an operator cab and a dust control system, the improvement comprising:

a viewport located in a floor of the operator cab wherein the dust control system includes a dust skirt underlying the floor, and the viewport is located outside the dust control system proximate to the dust skirt.

6. The invention of claim 5 wherein the viewport comprises a cutout in the floor sealed by a transparent material.

7. The invention of claim 6 wherein the rotary drill includes a set of controls and a seat disposed inside the operating cab enclosure.

8. The invention of claim 7 wherein the seat is disposed proximate to the viewport to permit a person sitting in the seat to look through the viewport.

* * * * *